US010858082B2

(12) United States Patent
Smith

(10) Patent No.: US 10,858,082 B2
(45) Date of Patent: Dec. 8, 2020

(54) FLEXIBLE ROTARY BRUSH HUB

(71) Applicant: Simon Edward Smith, Arroyo Grande, CA (US)

(72) Inventor: Simon Edward Smith, Arroyo Grande, CA (US)

(73) Assignees: Adi Ringer, Arroyo Grande, CA (US); Simon Edward Smith, Arroyo Grande, CA (US)

( * ) Notice: Subject to any disclaimer, the term of this patent is extended or adjusted under 35 U.S.C. 154(b) by 233 days.

(21) Appl. No.: 16/162,823

(22) Filed: Oct. 17, 2018

(65) Prior Publication Data

US 2019/0047668 A1 Feb. 14, 2019

Related U.S. Application Data

(63) Continuation of application No. 15/261,489, filed on Sep. 9, 2016, now Pat. No. 10,124,867.
(Continued)

(51) Int. Cl.
*B63B 59/08* (2006.01)
*E04H 4/16* (2006.01)
(Continued)

(52) U.S. Cl.
CPC ..... *B63B 59/08* (2013.01); *A46B 13/008* (2013.01); *A46B 13/02* (2013.01); *B08B 1/002* (2013.01);
(Continued)

(58) Field of Classification Search
CPC ..... B63B 59/08; B63B 2059/082; B63B 2059/085; E04H 4/1636; E04H 4/1618;
(Continued)

(56) References Cited

U.S. PATENT DOCUMENTS 487,198 A 11/1892 McCutchan
549,340 A 11/1895 Upham
(Continued)

FOREIGN PATENT DOCUMENTS

CA 2988561 11/2016
FR 3003483 9/2014
JP 2000337239 12/2000

OTHER PUBLICATIONS

International Search Report and Written Opinion for PCT/US2016/051061 mailed from the International Searching Authority dated Dec. 9, 2016.
(Continued)

*Primary Examiner* — Laura C Guidotti
(74) *Attorney, Agent, or Firm* — Fitch, Even, Tabin & Flannery LLP

(57) ABSTRACT

A rotary cleaning apparatus for underwater cleaning including a housing, a battery, a motor and a flexible hub system. The flexible hub system includes a toroidal brush system coupled to a circular centrifugal pump assembly. The flexible hub system includes a flexible hub allowing the flexible hub system to bend out of plane. When the flexible hub system is rotated underwater at a curved surface, the brush system cleans the surface while the suction of the centrifugal pump assembly flexes the flexible hub system to evenly contact the surface.

20 Claims, 12 Drawing Sheets

Related U.S. Application Data

(60) Provisional application No. 62/283,749, filed on Sep. 11, 2015.

(51) Int. Cl.
*A46B 13/00* (2006.01)
*A46B 13/02* (2006.01)
*B08B 1/00* (2006.01)
*B08B 1/04* (2006.01)

(52) U.S. Cl.
CPC ..... *B08B 1/04* (2013.01); *E04H 4/1618* (2013.01); *B63B 2059/085* (2013.01)

(58) Field of Classification Search
CPC ..... E04H 4/16; A46B 13/008; A46B 13/02; B08B 1/002; B08B 1/04
USPC ..... 15/1.7, 28, 180; 114/222
See application file for complete search history.

(56) References Cited

U.S. PATENT DOCUMENTS

| | | | | |
|---|---|---|---|---|
| 625,080 | A | | 5/1899 | Zerbe |
| 1,577,856 | A | | 3/1926 | Wingert |
| RE26,741 | E | | 12/1969 | Myers |
| 3,794,052 | A | | 2/1974 | Koble, Jr. |
| 3,886,616 | A | | 6/1975 | Hayes |
| 4,052,950 | A | | 10/1977 | Hirata |
| 4,084,535 | A | | 4/1978 | Rees |
| 4,314,521 | A | | 2/1982 | Lundberg |
| 4,322,866 | A | | 4/1982 | Brazzale |
| 4,574,722 | A | | 3/1986 | Orita |
| 4,619,217 | A | | 10/1986 | Wachi |
| 4,682,558 | A | | 7/1987 | Broersz |
| 4,688,289 | A | | 8/1987 | Urakami |
| 4,690,092 | A | | 9/1987 | Rabuse |
| 4,697,536 | A | | 10/1987 | Hirata |
| 4,809,383 | A | | 3/1989 | Urakami |
| 4,838,193 | A | * | 6/1989 | van der Tak ..... B63B 59/08 114/222 |
| 4,909,173 | A | | 3/1990 | Strong |
| 4,926,957 | A | | 5/1990 | Urakami |
| 4,997,052 | A | | 3/1991 | Urakami |
| 5,044,034 | A | | 9/1991 | Iannucci |
| 5,174,222 | A | | 12/1992 | Rogers |
| 5,525,027 | A | | 6/1996 | Jinno |
| 5,685,251 | A | | 11/1997 | Halko |
| 5,706,539 | A | | 1/1998 | Fukuda |
| 5,730,553 | A | | 3/1998 | Miura |
| 5,852,984 | A | | 12/1998 | Matsuyama |
| 5,867,856 | A | | 2/1999 | Herzog |
| 6,070,547 | A | | 6/2000 | Achord |
| 6,199,237 | B1 | | 3/2001 | Budden |
| 6,209,473 | B1 | | 4/2001 | Jones |
| 6,263,821 | B1 | | 7/2001 | Hodder |
| 6,691,811 | B2 | | 2/2004 | Bruntrup |
| 7,337,487 | B2 | | 3/2008 | Leonardi |
| 7,437,790 | B1 | | 10/2008 | Ajello |
| 7,690,066 | B2 | | 4/2010 | Stoltz |
| 7,905,192 | B1 | | 3/2011 | Hertellll |
| 10,124,867 | B2 | * | 11/2018 | Smith ..... B08B 1/002 |
| 2002/0073493 | A1 | | 6/2002 | Walton |
| 2004/0133999 | A1 | | 7/2004 | Walton |
| 2004/0194237 | A1 | | 10/2004 | Walton |
| 2005/0198752 | A1 | | 9/2005 | McGraw |
| 2005/0199171 | A1 | | 9/2005 | Ecklund |
| 2007/0056134 | A1 | | 3/2007 | Sheker |
| 2008/0083077 | A1 | | 4/2008 | Alexander |
| 2008/0229994 | A1 | | 9/2008 | Marr |
| 2010/0126403 | A1 | | 5/2010 | Rooney |
| 2010/0131098 | A1 | | 5/2010 | Rooney |
| 2012/0006244 | A1 | | 1/2012 | Vanrompay |
| 2012/0260861 | A1 | | 10/2012 | Lindgren |
| 2013/0133149 | A1 | | 5/2013 | Higgins |
| 2015/0128361 | A1 | | 5/2015 | Erlich |

OTHER PUBLICATIONS

Smith; U.S. Appl. No. 15/261,489, filed Sep. 9, 2016.
USPTO; Notice of Allowance for U.S. Appl. No. 15/261,489 dated Jul. 12, 2018.
Extended European Search Report issued in European Patent Application No. 16845166.4 dated Mar. 25, 2019.

* cited by examiner

FLEXIBLE ROTARY BRUSH HUB

This application is a continuation of U.S. application Ser. No. 15/261,489, filed Sep. 9, 2016, entitled FLEXIBLE ROTARY BRUSH HUB, which claims the benefit of U.S. Provisional Application No. 62/283,749, filed Sep. 11, 2015, entitled FLEXIBLE ROTARY BRUSH HUB WITH IMPELLER FOR UNDERWATER USE, both of which are incorporated in their entirety herein by reference.

BACKGROUND OF THE INVENTION

1. Field of the Invention

The present invention relates generally to rotary scouring apparatuses, and more specifically to underwater rotary scouring apparatuses.

2. Discussion of the Related Art

Pleasure craft and commercial vessels need to be cleaned below the waterline (i.e. underwater) on a regular basis. Current practices include a diver who uses a combination of brushes, pads and scrapers to hand-scrub the marine growth from the hull. Although some operators use powered scrubbers, they are typically hydraulically or pneumatically powered and require a connection from the powered scrubber to a boat- or shore-mounted power unit.

What is needed is a cordless powered mechanical system that can be used to clean marine growth from a hull's surface below the waterline while the vessel is floating in the water.

SUMMARY OF THE INVENTION

Several embodiments of the invention advantageously address the needs above as well as other needs by providing a flexible hub system arranged about a rotational axis, comprising: a disk-shaped impeller plate centered on the rotational axis and including a central impeller hole, a plurality of discharge outlets proximate to an outer edge of the impeller plate, and a plurality of radial impeller vanes located on a lower face of the impeller plate; a generally dome-shaped volute centered on the rotational axis and including a center volute hole, the volute coupled to the lower face of the impeller plate such that the vanes are interposed between the volute and the impeller plate; a disk-shaped flexible hub coupled to the impeller plate and covering the central impeller hole, wherein the flexible hub is comprised of a flexible material; a drive shaft centered on the rotational axis and coupled to the flexible hub and extending upward, whereby rotation of the drive shaft rotates the impeller plate around the rotational axis; and a toroidal brush removably coupled to a lower face of the volute proximate to an outer edge of the volute, whereby upon submerging of the flexible hub system in a fluid and rotation of the flexible hub system around the rotational axis the brush is rotated and fluid is drawn into the center volute hole and is discharged out the discharge outlets, whereby suction is created, whereby when the brush is placed at least near to a surface the suction flexes the flexible hub, whereby the brush is contoured to the surface while rotating.

In another embodiment, the invention can be characterized as a rotary brush apparatus, comprising: a housing; a battery coupled to the housing; a motor coupled to the housing and electrically coupled to the battery, the motor providing rotation about a rotational axis; a flexible hub system rotationally coupled to and powered by the motor, the flexible hub system arranged about the rotational axis and comprising: a disk-shaped impeller plate centered on the rotational axis and including a central impeller hole, a plurality of discharge outlets proximate to an outer edge of the impeller plate, and a plurality of radial impeller vanes located on a lower face of the impeller plate; a generally dome-shaped volute centered on the rotational axis and including a center volute hole, the volute coupled to the lower face of the impeller plate such that the vanes are interposed between the volute and the impeller plate; a disk-shaped flexible hub coupled to the impeller plate and covering the central impeller hole, wherein the flexible hub is comprised of a flexible material; a drive shaft centered on the rotational axis and coupled to the flexible hub and extending upward to and coupled to the motor, whereby rotation of motor rotates the impeller plate around the rotational axis; a toroidal brush coupled to a lower face of the volute proximate to an outer edge of the volute, whereby upon submerging of the flexible hub system in a fluid and rotation of the flexible hub system around the rotational axis the brush is rotated and fluid is drawn into the center volute hole and is discharged out the discharge outlets, whereby suction is created, whereby when the brush is placed at least near to a surface the suction flexes the flexible hub, whereby the brush is contoured to the surface while rotating.

BRIEF DESCRIPTION OF THE DRAWINGS

The above and other aspects, features and advantages of several embodiments of the present invention will be more apparent from the following more particular description thereof, presented in conjunction with the following drawings.

Figure 1:
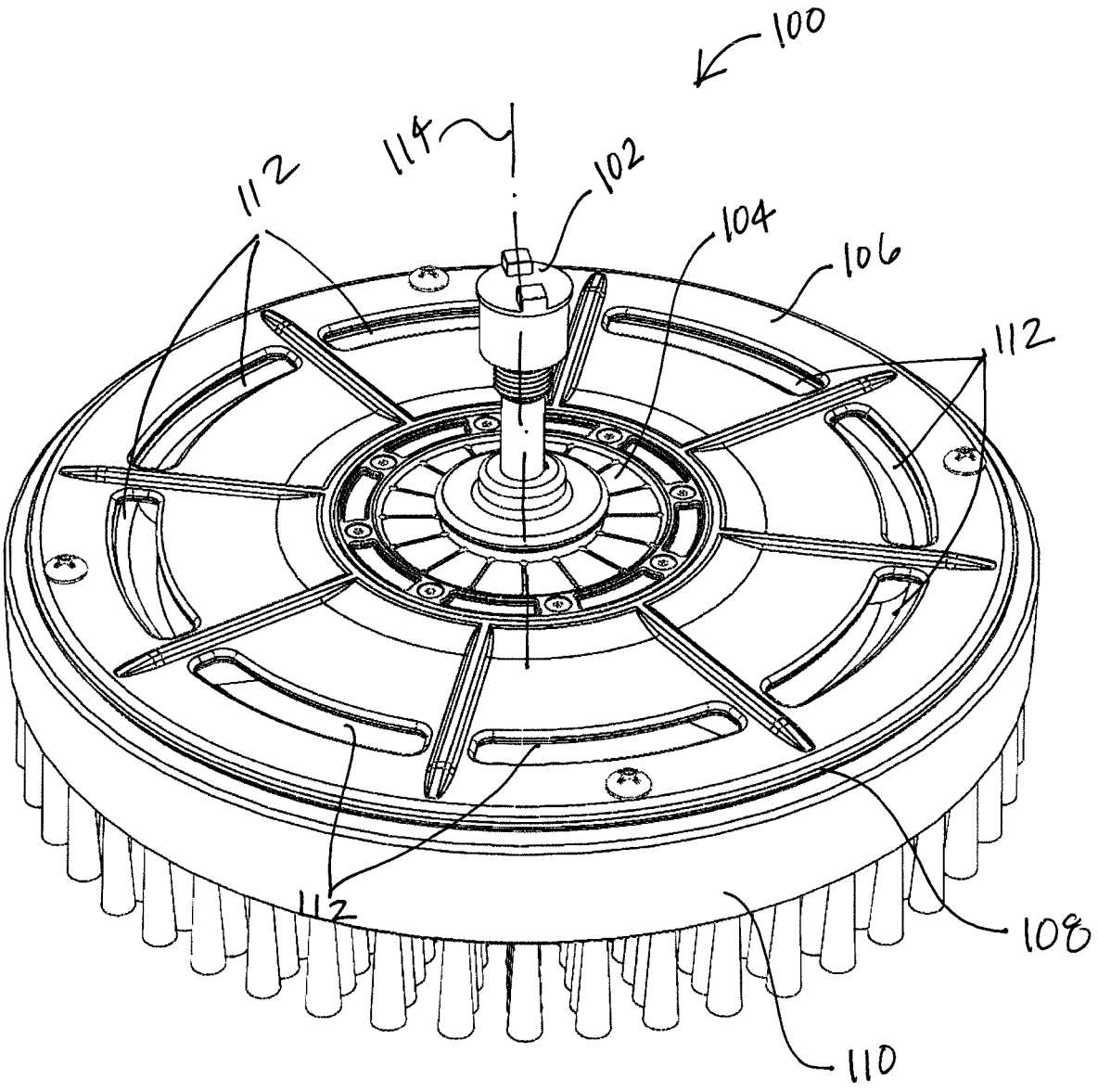
FIG. 1 is a perspective view of an upper side of a flexible hub system in one embodiment of the present invention.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention.

Also, common but well-understood elements that are useful or necessary in a commercially feasible embodiment are often not depicted in order to facilitate a less obstructed view of these various embodiments of the present invention.

DETAILED DESCRIPTION

The following description is not to be taken in a limiting sense, but is made merely for the purpose of describing the general principles of exemplary embodiments. The scope of the invention should be determined with reference to the claims.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided, such as examples of programming, software modules, user selections, network transactions, database queries, database structures, hardware modules, hardware circuits, hardware chips, etc., to provide a thorough understanding of embodiments of the invention. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

Referring first to FIG. 1, a perspective view of an upper side of a flexible hub system 100 is shown in one embodiment of the present invention. Shown are a drive shaft 102, a flexible hub 104, an impeller plate 106, a volute 108, a brush assembly 110, a plurality of discharge outlets 112, and a rotational axis 114. In this specification, with reference to the flexible hub system 100 the direction upwards refers to the direction towards the drive shaft 102. The direction downwards refers to the direction towards the brush assembly 110.

The flexible hub system 100 comprises the drive shaft 102, the flexible hub 104, the impeller plate 106, the volute 108 and the brush assembly 110, all coupled together arranged on the central rotational axis 114 to form the flexible hub system 100. The drive shaft 102 is configured to couple to and be rotated by a motor, whereby the motor rotates the drive shaft 102 and thus the entire flexible hub system 100 about the rotational axis 114. One embodiment of an apparatus including a motor is shown below in FIGS. 7-10.

The flexible hub system 100 is arranged with the impeller plate 106 and flexible hub 104 forming an upper side of the flexible hub system 100, with the drive shaft 102 extending upward from the upper side. The volute 108 is coupled to a lower side of the impeller plate 106, and the brush assembly 110 is coupled to a lower side of the volute 108, whereby the volute 108 is interposed between the impeller plate 106 and the brush assembly 110. In the present embodiment, the brush assembly 110 is removably coupled to the volute 108 with a plurality of threaded fasteners, whereby the brush assembly 110 can be replaced, for example for a brush assembly including stiffer or softer bristles.

The impeller plate 106 includes the plurality of discharge outlets 112 proximate to an outer edge of the impeller plate 106. In the present embodiment, the impeller plate 106 includes eight discharge outlets 112 evenly spaced with respect to the outer edge. The discharge outlets 112 are of a constant width in a radial direction of the impeller plate 106, and curved to match the outer edge of the impeller plate 106. A total area of the discharge outlets 112 is configured to provide the necessary fluid flow for the required centrifugal fluid flow of the flexible hub system 100. The impeller plate 106 is comprised of molded plastic or metal.

Figure 2:
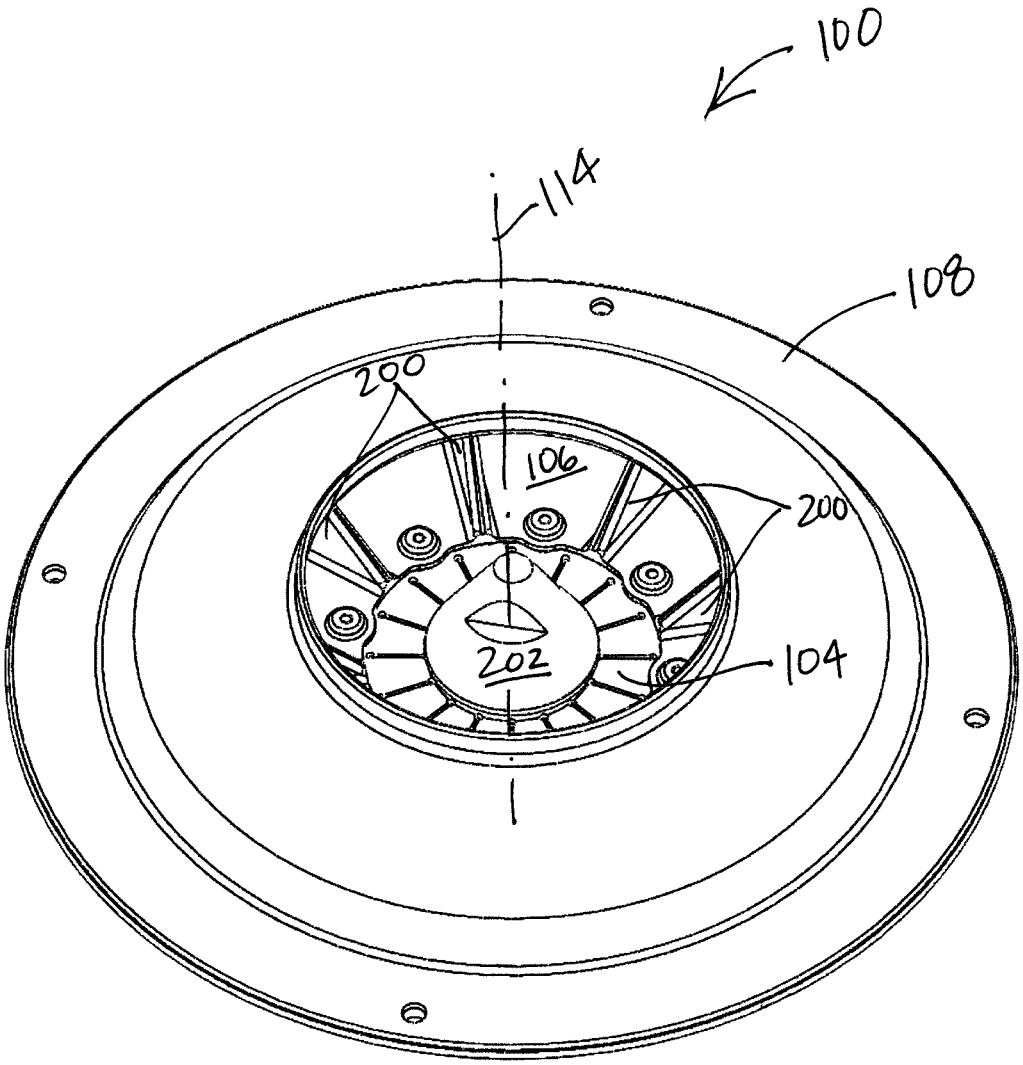
FIG. 2 is a lower perspective view of a lower side of the flexible hub system, with a brush omitted for clarity.

Referring next to FIG. 2, a perspective view of a lower side of the flexible hub system 100 is shown. The brush assembly 110 has been omitted for clarity. Shown are the flexible hub 104, the impeller plate 106, the volute 108, the rotational axis 114, a plurality of vanes 200, and a spinner 202.

The volute 108 is generally dome-shaped with a circular central volute hole 502. In the present embodiment, the volute 108 includes a flange at a base of the volute 108 for coupling the volute 108 to the impeller plate 106. The volute 108 is coupled to the lower side of the impeller plate 106 proximate to an outer perimeter of the volute 108. In the present embodiment the volute 108 is coupled to the impeller plate 106 using a permanently molded, welded or fastened joint. The volute 108 is comprised of molded plastic or metal, and is typically the same material as the impeller plate 106. The impeller plate 106 includes the plurality of vanes 200 extending downward from the lower side of the impeller plate 106. The flexible hub system 100 also includes the spinner 202 threadably or otherwise mechanically coupled to the drive shaft 102 on the lower side of the impeller plate 106. The configuration of the spinner 202 allows the brush assembly 110/centrifugal pump assembly 300 to be removed from the drive shaft 102 with tools or without tools.

Figure 3:
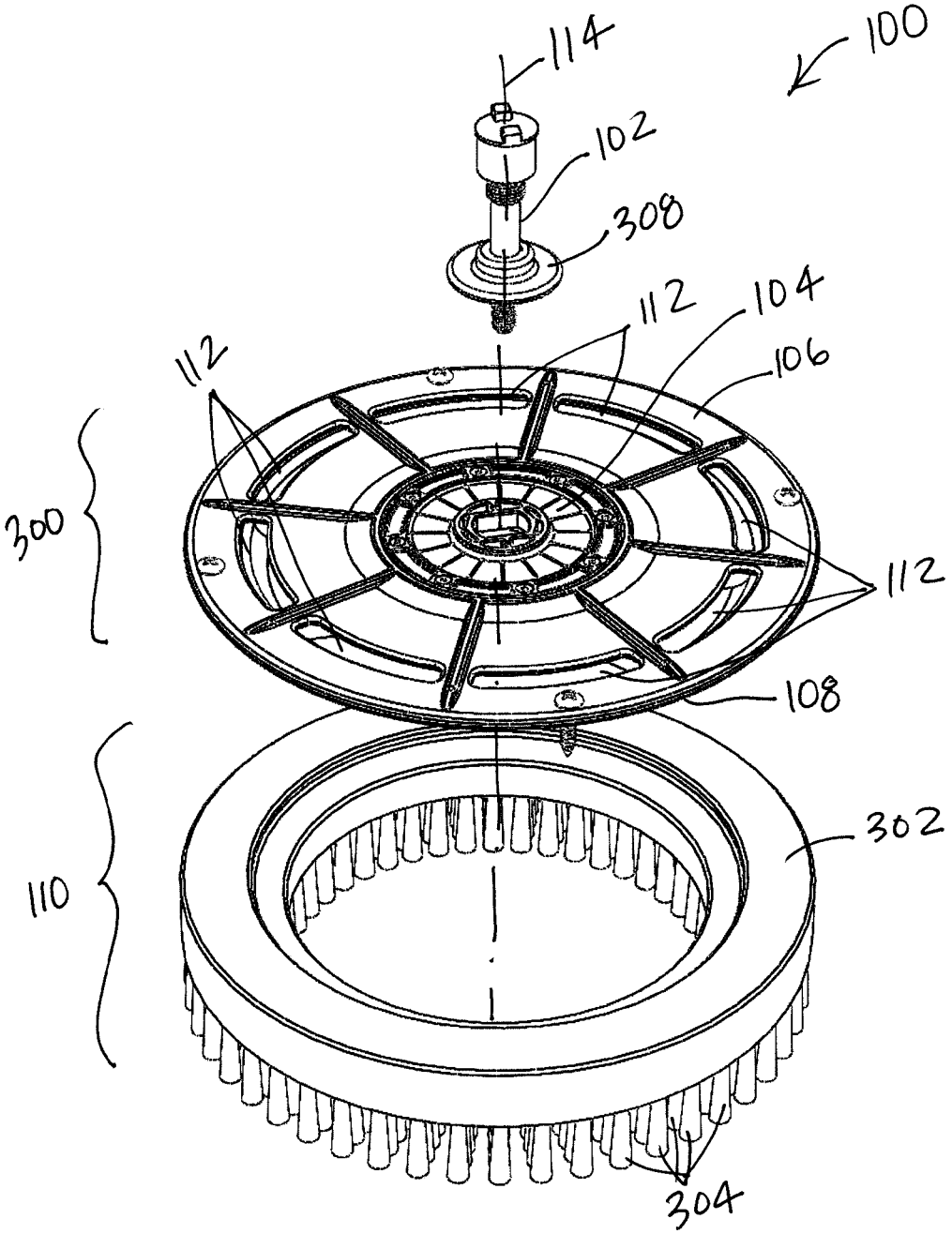
FIG. 3 is an exploded view of the flexible hub system from the upper side.
Figure 4:
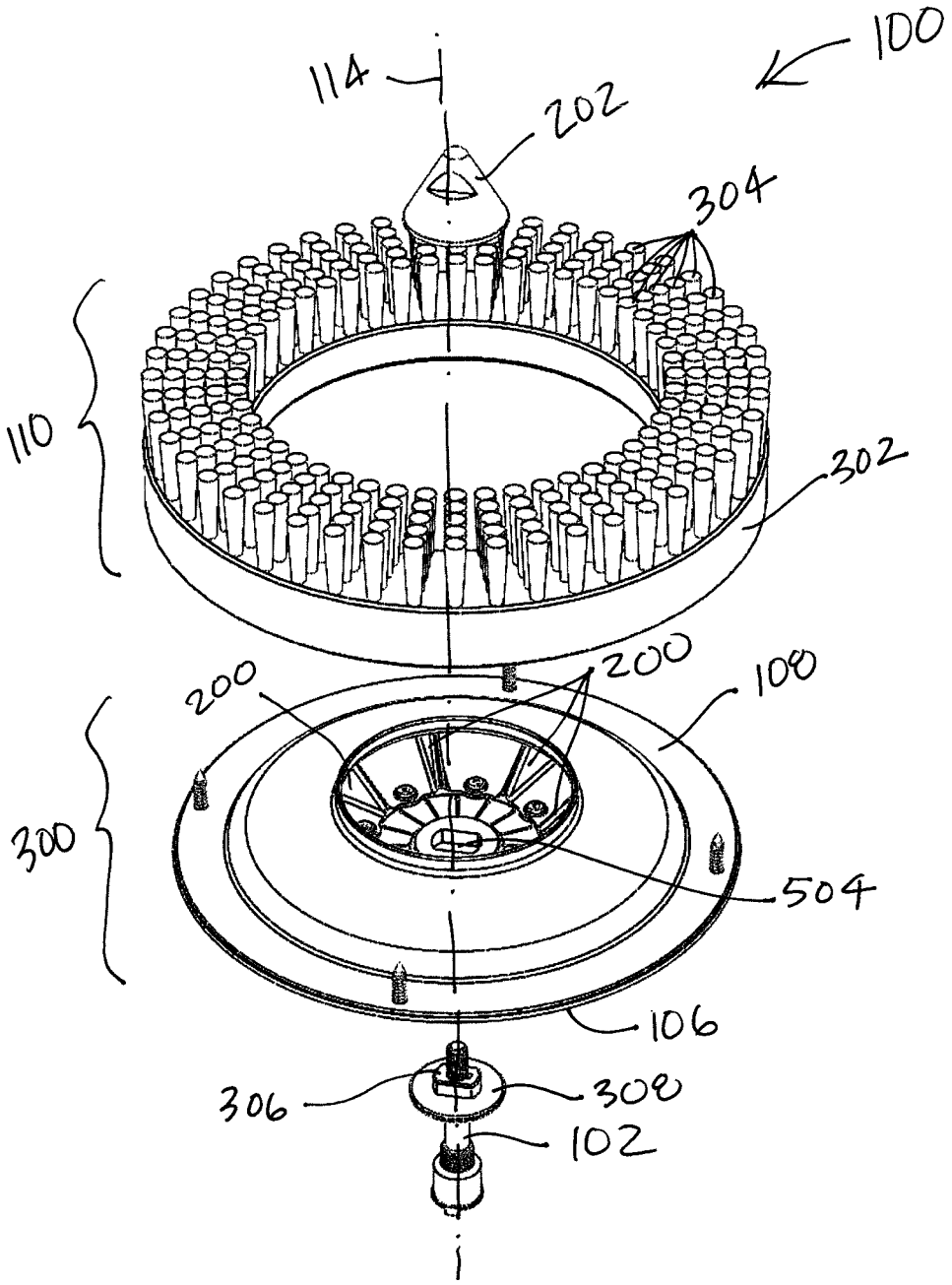
FIG. 4 is an exploded view of the flexible hub system from the lower side.

Referring next to FIGS. 3 and 4, a partially exploded view of the flexible hub system 100 from the upper side and lower side, respectively, are shown. Shown are the drive shaft 102, the flexible hub 104, the impeller plate 106, the volute 108, the brush assembly 110, the plurality of discharge outlets 112, the rotational axis 114, the plurality of vanes 200, the spinner 202, a centrifugal pump assembly 300, a base 302, a plurality of bristles 304, a boss 306, an adapter plate 308, and a key hole 504.

The impeller plate 106, flexible hub 104 and the volute 108 are coupled together to form the centrifugal pump assembly 300, wherein during rotation of the flexible hub system 100 fluid is drawn in through the central volute hole 502 and pushed out through the discharge outlets 112 by the rotation of the impeller blades. The configuration of the centrifugal pump assembly 300 is described further below.

The brush assembly 110 comprises the toroidal base 302 including an outer edge generally coinciding with the volute 108 outer edge. The plurality of bristles 304 are coupled to an upper side of the base 302 and extend upward. The bristles 304 are of size, shape, material, flexibility and density to provide the required scrubbing action to a surface. The brush assembly 110 can be configured and made available in with bristles 304 of different lengths, types, and materials to match the type of surface being scrubbed. The combination of the base 302 thickness and the bristle lengths are configured to extend past the upper extent of the volute 108 such that under operating conditions the flexible hub system 100 can be used to scrub the surface using the bristles 304 without the volute 108 contacting the surface.

The drive shaft 102 passes through and is rotationally coupled to the disk-shaped adapter plate 308, with the center of the adapter plate 308 aligned with the longitudinal axis of the drive shaft 102. In the present embodiment a side of the drive shaft 102 includes a square projection which fits within a square keyway 1100 of the adapter plate 308 (as shown below in FIG. 11), whereby the adapter plate 308 and the drive shaft 102 are rotationally locked together. The boss 306 projects downwards from the lower face of the adapter plate and is configured to be received by the key hole 504. The adapter plate 308 is comprised of metal, an engineering thermoplastic, or other suitable material. A first upper end of the drive shaft 102 is configured to couple to and be rotated by the motor (not shown). The adapter plate is described further below in FIG. 11.

A second lower end of the drive shaft 102 proximate to the brush assembly 110 is configured to receive the spinner 202. When assembled, the boss 306 is fit into the central key hole 504 of the flexible hub 104 to provide rotational constraint, whereby the first end extends downwards past the flexible hub 104 but is restrained from further downwards movement by the adapter plate 308 contacting the upper (outer) side of the flexible hub 104. The second end receives the spinner 202 (or other suitable fastener, whereby the flexible hub 104 is interposed between the spinner 202 and the adapter plate 308, and the flexible hub 104 is rigidly yet removably coupled to the drive shaft 102. In other embodiments the drive shaft 102 may be permanently coupled to the flexible hub 104.

Figure 5:
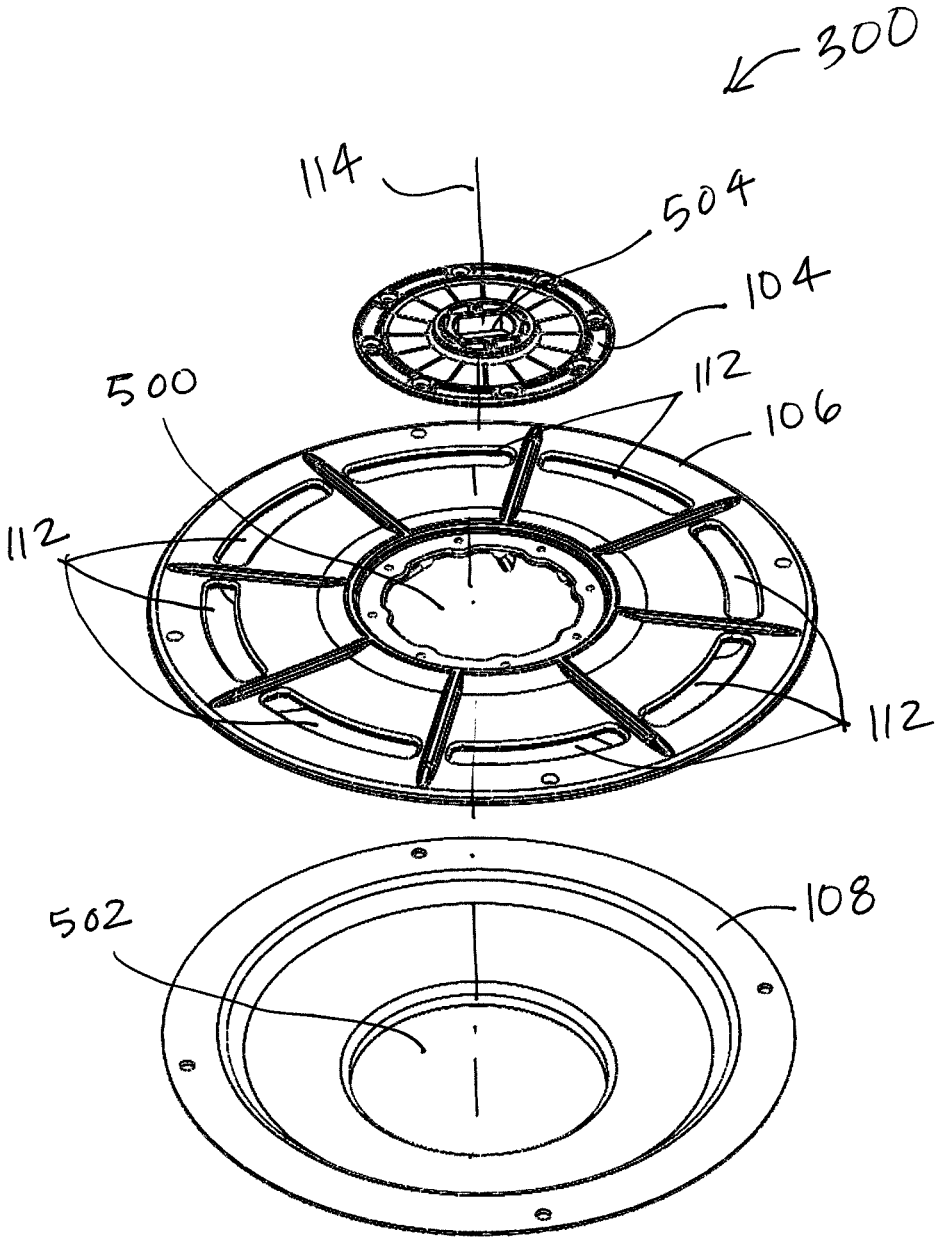
FIG. 5 is an exploded view from an upper side of a centrifugal pump assembly of the flexible hub system.
Figure 6:
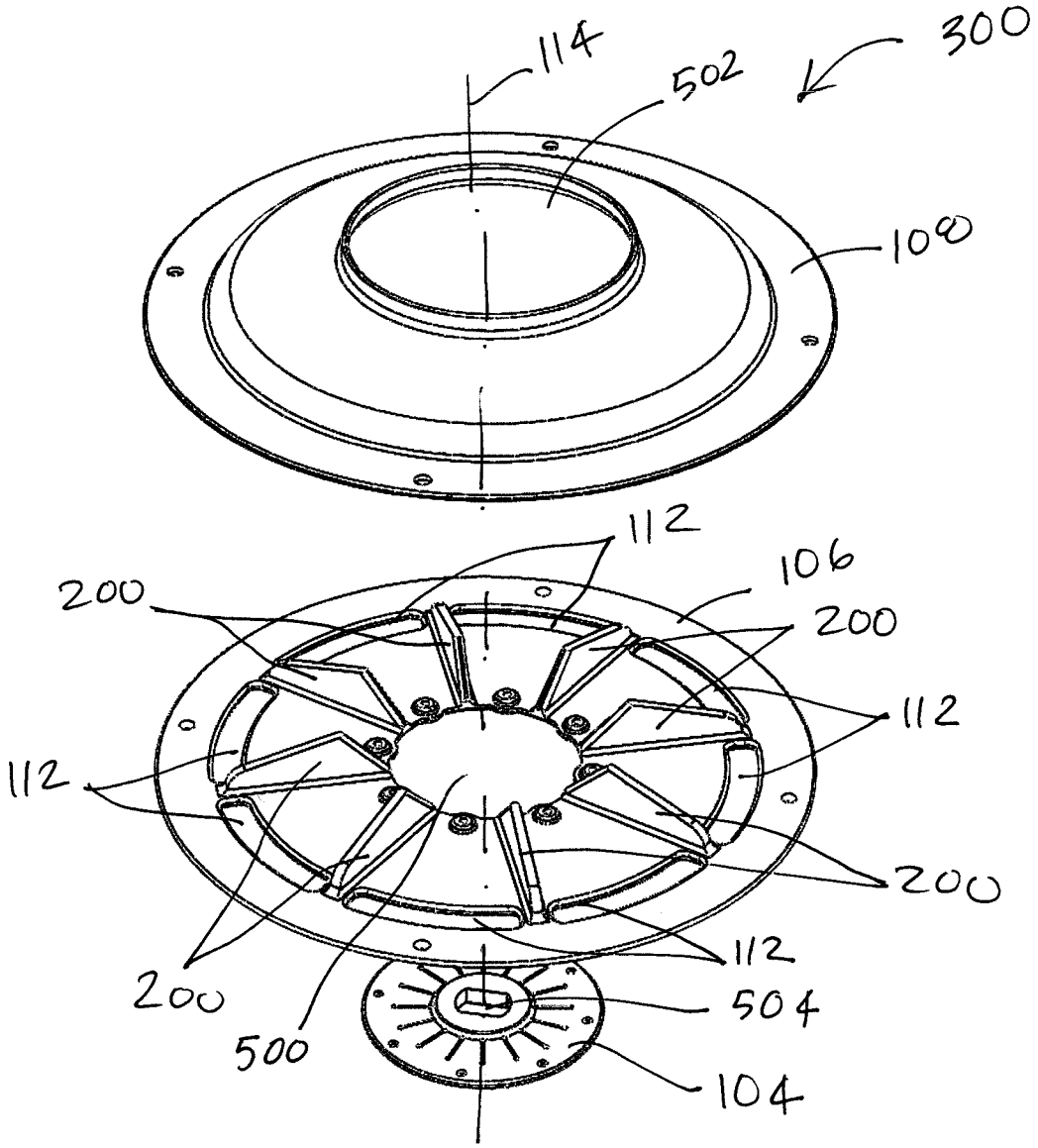
FIG. 6 is an exploded view from a lower side of the centrifugal pump assembly.

Referring next to FIGS. 5 and 6, an exploded view of the centrifugal pump assembly 300 from the upper side and the lower side, respectively, are shown. Shown are the flexible hub 104, the impeller plate 106, the plurality of discharge outlets 112, the rotational axis 114, the plurality of vanes 200, a central impeller hole 500, the central volute hole 502, and the key hole 504.

As previously described, the flexible hub 104, the impeller plate 106 and the volute 108 are arranged on the rotational axis 114. The impeller plate 106 includes the generally circular central impeller hole 500 and the discharge outlets 112. The flexible hub 104 is disk-shaped with the central key hole 504. The key hole 504 is shaped to receive the boss 306 of the adapter plate 308. When assembled, the adapter plate 308 is juxtaposed with and rigidly coupled to a lower side of the flexible hub 104. The flexible hub 104 is configured to cover the central impeller hole 500. In the present embodiment, the flexible hub 104 overlaps an inner edge of the lower side impeller plate 106 and is rigidly coupled to the impeller plate 106 with a plurality of fasteners proximate to the outer edge of the flexible hub 104. In other embodiments the flexible hub 104 is attached using adhesives or may be co-molded as an integral part of the impeller plate 106.

The flexible hub 104 is comprised of an elastomeric material and provides flexibility between the rigid impeller plate 106 and the rigid adapter plate 308. The flexible hub 104 is constrained in the center by the spinner 202 and the rigid adapter plate 308 and constrained at the perimeter by the coupling to the impeller plate 106 using fasteners or other attachment method to mechanically coupled the flexible hub 104 to the impeller plate 106. Thus, the flexibility of the flexible hub 104 is restricted to a slotted outer ring portion of the flexible hub 104 (as described further below in FIGS. 12 and 13). The amount of flexibility is variable and is dependent on the size of the adapter plate 308 and the degree of stiffness or compliance of the flexible hub 104. In operation the flexible hub 104 allows the brush assembly 110 to rotate radially with respect to the plane of the impeller plate 106 around the entire perimeter of the flexible hub 104, whereby the brush is allowed to follow the contour of a curved or otherwise non-flat surface.

As shown in FIG. 6, the lower side of the impeller plate 106 includes the radial vanes 200 extending outward from the lower side of the impeller plate 106. The vanes 200 are generally triangular in shape, with the apex of the triangle located proximate to the central impeller hole 500. The vanes 200 in the present embodiment are linear to provide for the same operation in either rotational direction, but in some embodiments the vanes 200 may be curved. In the present embodiment, the impeller plate 106 includes eight radial vanes 200 evenly spaced around the impeller plate 106. Each discharge outlet 112 is located between adjacent vanes 200 proximate to the outer edge of the impeller plate 106.

Referring again to FIGS. 1-6, the flexible hub system 100 is configured to be coupled to mechanical rotational source such that the drive shaft 102 is rotated, resulting in rotation of the entire flexible hub system 100. All connections of the elements of the flexible hub system 100 are rigid connection such that the flexible hub system 100 rotates as a single unit.

When the flexible hub system 100 is rotated and submerged under a fluid, typically water, the rotation of the centrifugal pump assembly 300 causes the fluid to be drawn into the central volute hole 502, be rotated and drawn radially outward via the impeller vanes 200, and be discharged from the centrifugal pump assembly 300 through the discharge outlets 112. This results in a suction at the central volute hole 502 vicinity. Simultaneously, the brush assembly 110 is also rotating. When the brush assembly 110 is placed near to or in contact with a surface, the suction causes the brush assembly 110 to be pulled towards the surface. The flexible hub 104 allows the brush assembly 110 to be rotated out of the plate of the impeller plate 106 by the suction to fully contact curved surfaces and non-flat surfaces such as boat hulls. The rotating of the brush assembly 110 provides a scrubbing action to the surface while the brush assembly 110 is simultaneously pulled towards the surface by the suction action of the centrifugal pump assembly 300, providing a continuous pressure to the surface. The pressure is increased by higher rotation speeds and decreased by lower rotation speeds. The suction also provides additional pressure of the brush assembly 110 to the surface, reducing time and physical effort in cleaning the underwater surface. In one example, the flexible hub system 100 is used to clean underwater portions of boat hulls.

In contrast, hand-held tools for underwater cleaning including rigid brushes, i.e. without the flexible hub 104, provides unequal pressure to underwater surfaces, causing the tool to bounce and/or vibrate at a low frequency, making control of the tool difficult and increasing operator fatigue. A hand-held brush tool utilizing the novel combination of the flexible hub 104 and the centrifugal pump assembly 300 as described herein provides equal pressure to the underwater surface. The flexible hub system 100 is enabled to be rotated in either direction, providing the same centrifugal pump suction in either direction, providing a way to equalize brush wear and allowing the user to use the flexible brush system in a manner with which they are most comfortable, i.e. left-handed or right-handed.

Figure 7:
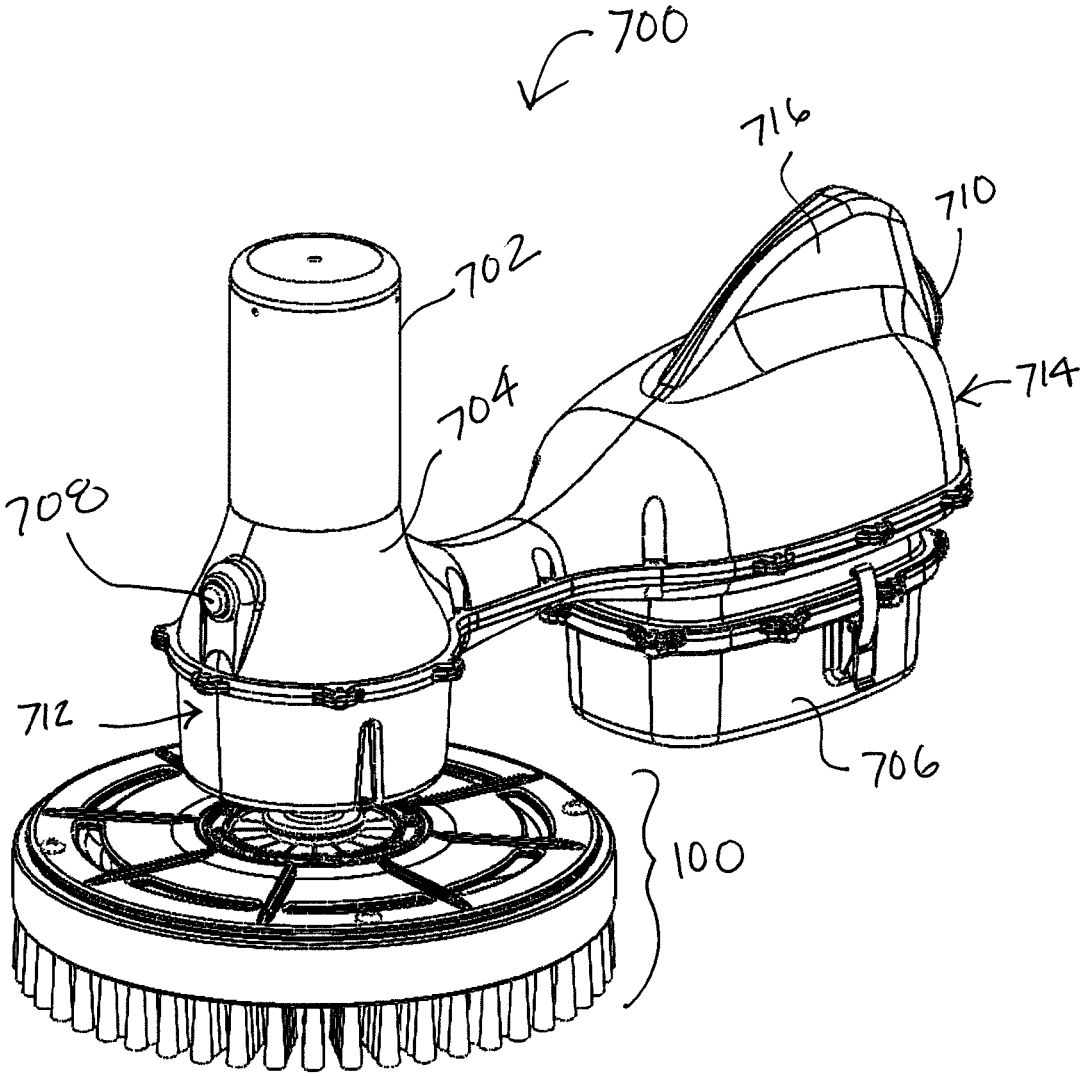
FIG. 7 is a front perspective view of an exemplary rotary cleaning apparatus in another embodiment of the present invention.
Figure 8:
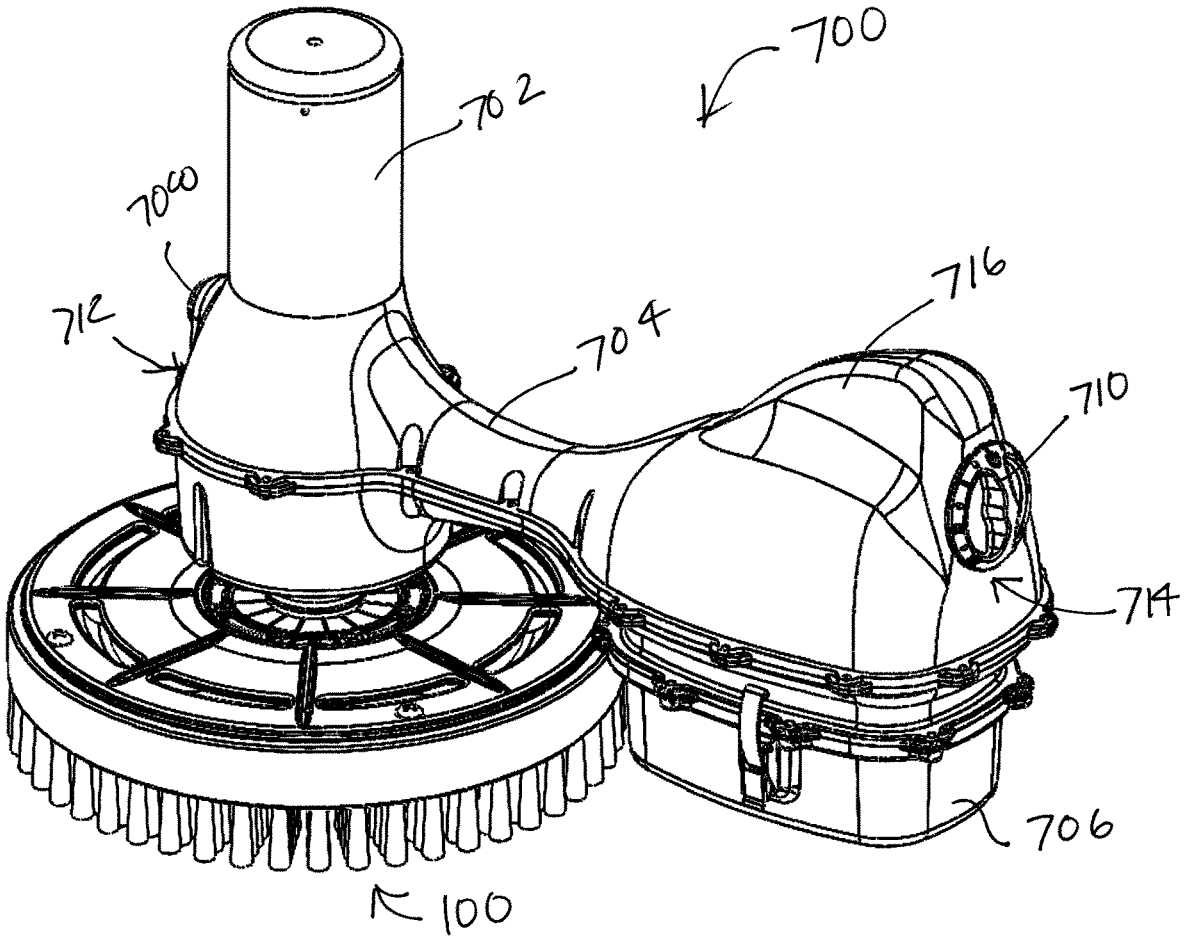
FIG. 8 is a rear perspective view of the rotary cleaning apparatus.
Figure 9:
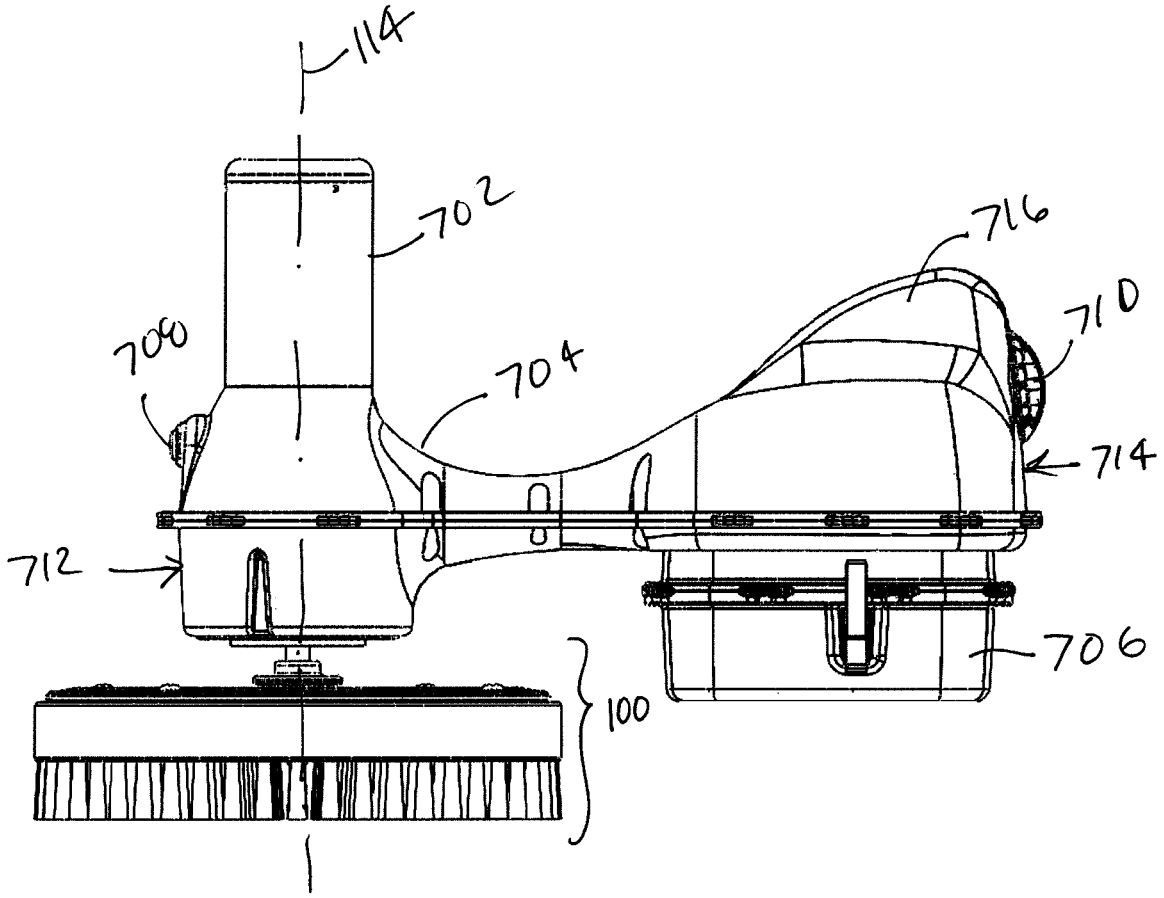
FIG. 9 is a side perspective view of the rotary cleaning apparatus.

Referring next to FIGS. 7-9, a front perspective view, a rear perspective view, and a side elevational view, respectively, of an exemplary rotary cleaning apparatus 700 are shown in another embodiment of the present invention. Shown are the flexible hub system 100, the rotational axis 114, a motor housing 702, a housing 704, a battery housing 706, a pause button 708, a variable speed and direction control (VSD) dial 710, a front end 712, a rear end 714, and an optional rear fin 716.

In another embodiment, the flexible hub system 100 as previously described is included in the rotary cleaning apparatus 700. The rotary cleaning apparatus 700 includes the housing 704 extending generally linearly from the front end 712 of the apparatus 700 to the rear end 714 of the apparatus 700. An underside of a front portion of the housing 704 is configured to receive the drive shaft 102 of the flexible hub system 100, wherein the drive shaft 102 extends downward from the housing 704, whereby the drive shaft 102 is coupled to and rotated by a motor 1006 housed within the motor housing 702. The motor housing 702 is waterproofly coupled to a top side of the front portion. In the present embodiment the motor housing 702 is a metal "can" shape and is configured to serve as a heat sink to cool the motor 1006. An underside of the rear portion is configured to removably and waterproofly couple to the battery housing 706, and also provide electrical coupling from a battery 1002 housed within the battery housing 706 to electrical components of the rotary cleaning apparatus 700. The housing 704 includes the pause button 708 at the front end 712 of the apparatus 700, which is described further below. The pause button 708 passes through a linear waterproof seal in the housing 704. In the present embodiment, pressing the pause button 708 actuates a switch inside the housing 704 immediately behind the pause button 708. The switch is coupled to an electronic speed control 1000 inside the housing 704. A spring in the interior of the housing 704 is coupled to the pause button 708 and biased to return the pause button 708 to the original position after pressing.

The housing 704 includes the VSD dial 710 at the rear end 714 of the housing 704, which is configured to provide variable rotational control of the flexible hub system 100 and is described further below. The housing 704 includes a waterproof rotary seal at the VSD dial 710 to prevent water intrusion. The battery housing 706 includes the battery 1002. In the present embodiment the battery 1002 is a rechargeable 17.5 Ah or 21 Ah lithium battery. The battery housing 706 and the housing 704 are configured to provide a waterproof seal when the battery housing 706 is coupled to the housing 704, whereby no water can enter either the housing 704 or the battery housing 706 when coupled. The rotary cleaning apparatus 700 in one embodiment is configured to be waterproof and submersible.

As previously described, the drive shaft 102 is configured to removably coupled to the flexible hub 104, whereby the centrifugal pump assembly 300 and the brush assembly 110 can be removed from the housing 704 and reattached.

The housing 704 is also configured to house the interior electrical and mechanical components of the rotary cleaning apparatus 700 shown below in FIG. 10. A central portion of the housing 704 between the front end 712 (the motor end) and the rear end 714 (the battery end) is generally cylindrical and configured to be gripped by one hand. In one embodiment, the housing 704 includes the optional rear fin 716 on the upper side of the rear portion which may be used as forearm support when the central portion or the motor housing 702 is gripped. The fin may also be used as a grip.

In another embodiment of the rotary cleaning apparatus 700, vents can be added to adapt the apparatus 700 for above-water applications.

Figure 10:
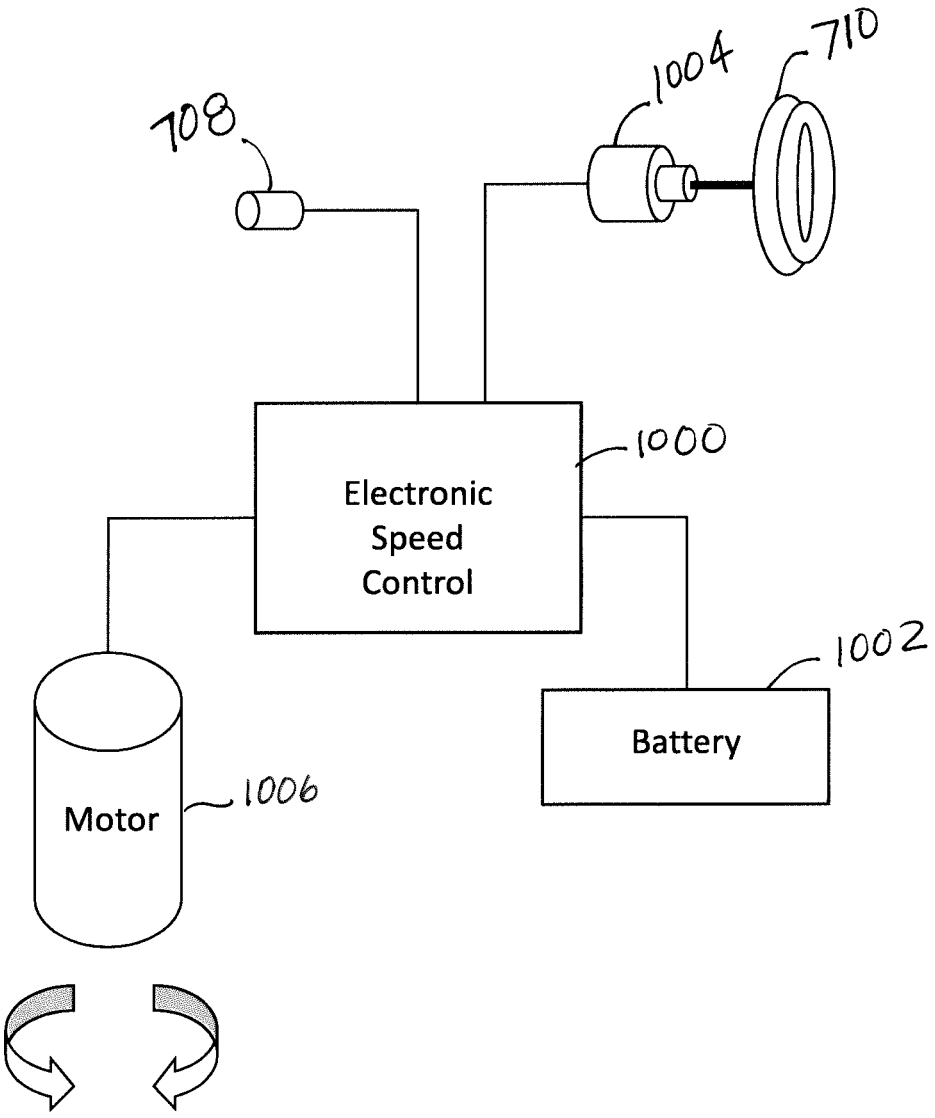
FIG. 10 is a schematic diagram of a control system for the rotary cleaning apparatus.

Referring next to FIG. 10, a schematic diagram of a control system for the rotary cleaning apparatus 700 is shown. Shown are, the pause button 708, the VSD dial 710, the electronic speed control 1000, the battery 1002, and a potentiometer 1004, and the motor 1006.

The battery 1002 is electrically coupled to and provides power for the electronic speed control 1000 and the motor 1006. In one embodiment the motor 1006 is a direct current brushed or brushless motor. The motor 1006 is electrically coupled to the electronic speed control (ESC) 1000 and is operatively controlled by the electronic speed control 1000. In one embodiment the electronic speed control 1000 is a variable speed drive controller suitable for either DC brushed or brushless motor control. The ESC 1000 is configured to sense (via at least one internal sensor), receive and log operational data, including but not limited to hours used, maximum current (amperage), average current (amperage), internal ambient temperature, and temperature of critical electrical components. The ESC 1000 is configured to allow the data to be accessed by a technician. The ESC 1000 is configured to gradually increase and decrease the speed of the motor 1006 (soft ramp start and stop. The soft ramp start and stop are provided to reduce the torque felt by the operator during starting and stopping. The ESC 1000 is also configured to shut off the apparatus 700 (i.e. stop the motor 1006) safely to prevent damage to the apparatus 700, including shut-off due to high temperature and due to high current.

The potentiometer 1004 is electrically coupled to the ESC 1000, which receives signals from the potentiometer 1004, which in turn is operatively controlled by the VSD dial 710. The pause button 708 is electrically coupled to the electronic speed control 1000.

In one method of operation, a user first installs the battery 1002. Upon installation of the battery 1002 the apparatus 700 defaults to an "off" operating state. Upon pressing of the pause button 708 by the user, an indication of an "on" operating state is sent to the ESC 1000. During operation of the apparatus 700, pressing of the pause button 708 toggles the apparatus 700 between the "on" operating state and the "off" operating state.

If the current and temperature are within acceptable limits, the ESC 1000 continuously monitors the VSD dial 710 and adjusts the speed and direction of the motor 1006 accordingly. If the VSD dial 710 is in a zero RPM position, the motor 1006 does not run, even if the apparatus 700 is in the "on" operating state. If, while in the "on" operating state, the VSD dial 710 is turned counterclockwise from the zero RPM position, the ESC 1000 controls the motor 1006 to rotate the flexible hub system 100 in a counterclockwise direction. If the VSD dial 710 is turned clockwise from the zero RPM position, the ESC 1000 controls the motor 1006 to rotate the flexible hub system 100 in a clockwise direction. As the VSD dial 710 is turned farther from the zero RPM position, the rotational speed increases.

Upon initially toggling from the "off" operating state to the "on" operating state, the ESC 1000 is configured to activate the motor 1006 in the "soft start", i.e. ramping up the motor speed incrementally to the rotational speed indicated by the position of the VSD dial 710. The ESC 1000 also continuously monitors and logs sensor data while in the "on" operating state. If at any time the current or temperature is over a pre-set limit, the ESC 1000 ramps down the motor speed to zero RPM (if the motor 1006 is running) and sets the operating state to "off". The apparatus 700 sill not respond to commands to return to the "on" operating state until all current sensor data is within the pre-set limits.

While in the "off" operating off state the ESC 1000 only monitors the pause button 708 and internal communication buses. Upon initial toggle from the "on" operating state to the "off" operating state, the ESC 1000 directs the motor 1006 to "soft stop", i.e. ramping down the motor speed incrementally to a stop position (i.e. zero RPM). Pressing of the pause button 708 will toggle the apparatus 700 back on to the rotational speed/direction indicated by the VSD dial 710. While in the "off" operating state, service technicians may send a command through the communication bus of the ESC, whereby the apparatus 700 externally transmits saved data and/or the operational parameters of the apparatus 700 may be changed.

To turn off the apparatus 700, the pause button 708 is pressed, whereby the operating state is set to "off", and the VSD dial 710 is rotated to the zero RPM position.

The VSD dial 710 allows the user to conveniently select a speed and rotational direction appropriate for the cleaning task. The pause button 708 allows the user to stop the machine as needed and then restart at the same speed and rotational direction.

Figure 11:
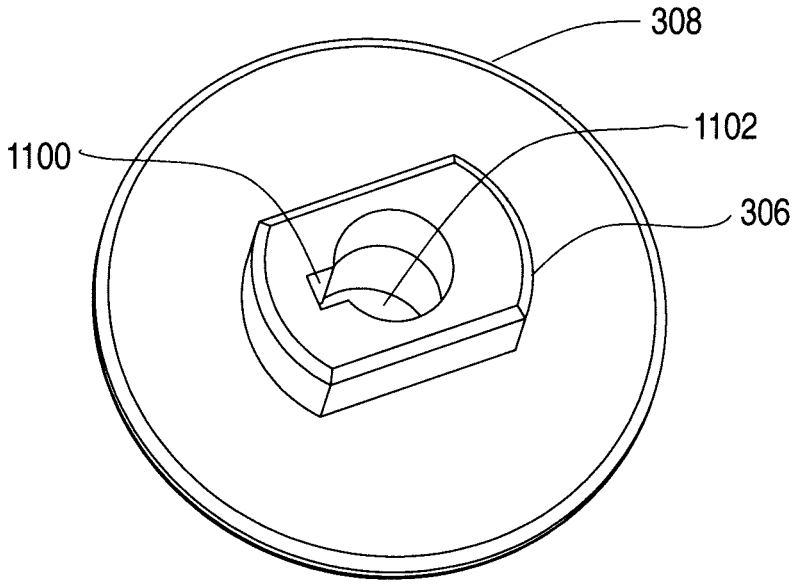
FIG. 11 is a perspective view of a lower side of an adapter plate of the flexible hub system.

Referring next to FIG. 11, a perspective view of the lower side of the adapter plate 308 is shown. Shown are the boss 306, the drive shaft hole 1102 and the square keyway 1100.

As previously described, the adapter plate 308 is disk-shaped, with the boss 306 projecting downward from the underside of the adapter plate 308. In the embodiment shown the boss 306 is generally rectangular-shaped, although any shape may be used in order to restrain rotation between the adapter plate 308 and the flexible hub 104.

The adapter plate 308 includes the central drive shaft hole 1102, which is a through-hole configured to allow a portion of the drive shaft 102 to pass through the adapter plate 308 and receive the spinner 202. The adapter also includes the square through-hole of the square keyway 1100, which is contiguous to the drive shaft hole 1102 and configured to receive the square projection of the drive shaft 102, whereby when the drive shaft 102 is coupled to the flexible hub 104 and the adapter plate 308 the square projection is located within the square keyway 1100 and therefore restrains rotation between the adapter plate 308 and the drive shaft 102. It will be understood that the shape of the square projection and the square keyway 1100 may be any shape whereby rotation is restrained.

Figure 12:
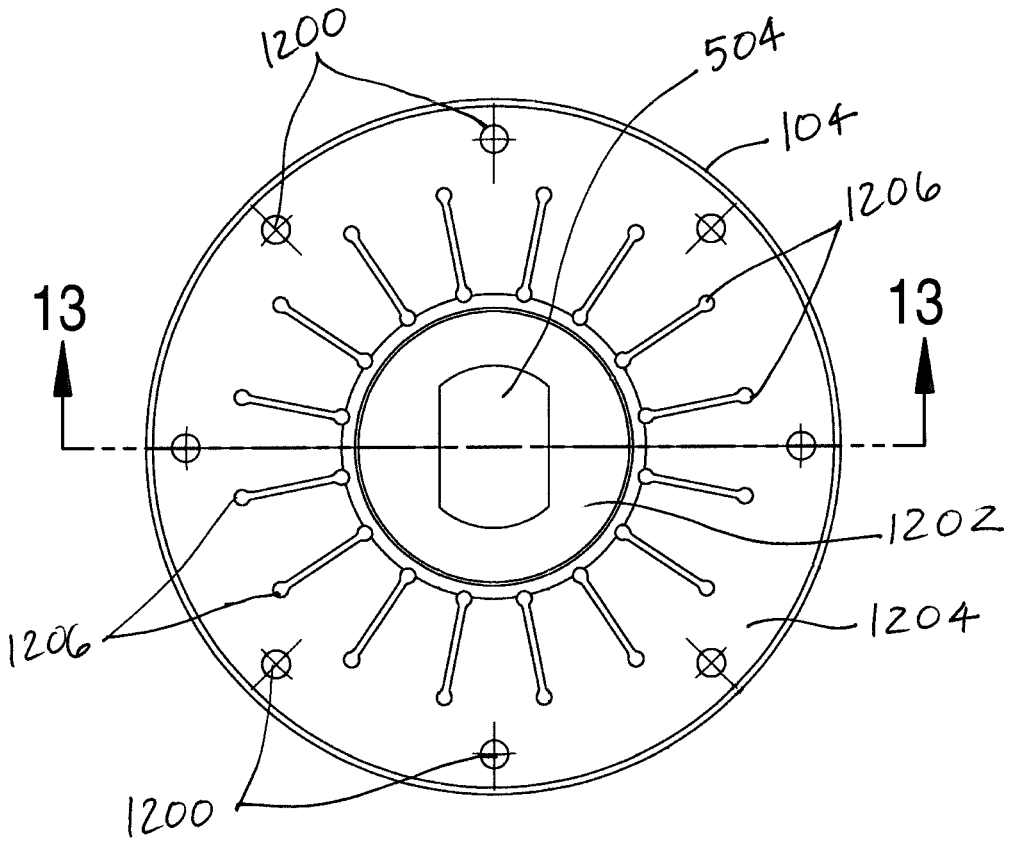
FIG. 12 is a plan view of a lower side of a flexible hub of the flexible hub system.

Referring next to FIG. 12, a plan view of a lower side of the flexible hub 104 is shown. Shown are the key hole 504, a plurality of fastener holes 1200, a center portion 1202, an outer ring 1204, and a plurality of hub slots 1206.

As previously described, the flexible hub 104 is generally disk-shaped with a central key through-hole 504 configured to receive the boss 306 snugly within the key hole 504. The circular center portion 1202 of the flexible hub 104 includes the key hole 504 and has a first thickness. The flexible hub 104 also includes the outer ring 1204 around the center portion 1202. The outer ring 1204 is integral with the center portion 1202 and has variable thicknesses which are less than the first thickness. The outer ring 1204 also includes the plurality of radial hub slots 1206 and the plurality of fastener holes 1200. The hub slots 1206 pass through the outer ring 1204 and the width of the slots and spacing of the slots are dependent on the desired "spring" action of the portions of the flexible hub 104 between hub slots 1206. The flexible hub 104 also includes the plurality of fastener holes 1200 configured to receive fasteners coupling the flexible hub 104 to the impeller plate 106.

Figure 13:
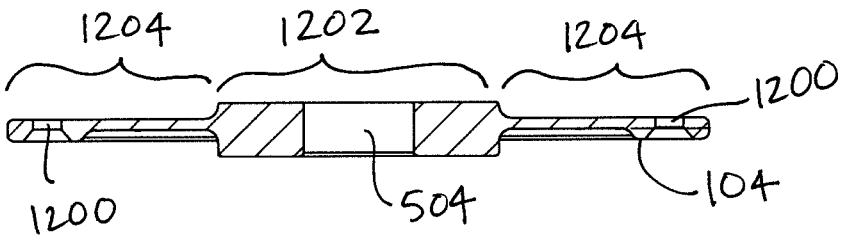
FIG. 13 is a sectional view of the flexible hub of FIG. 12.

Referring next to FIG. 13, a sectional view of the flexible hub 104 is shown. Shown are the key hole 504, the fastener holes 1200, the center portion 1202, and the outer ring 1204.

As shown in FIG. 13, the flexible hub 104 is thicker at the center portion 1202 including the key hole 504, and thinner at the perimeter portion (the outer ring 1204). The outer ring 1204 includes an outer perimeter portion which includes the fastener holes 1200 and is thicker than the inner portion of the outer ring 1204. The outer perimeter portion is configured to couple to and be restrained by the impeller plate 106. The inner portion is thinner than the outer perimeter portion and includes the hub slots 1206.

Referring again to FIGS. 12 and 13, the inner portion of the outer ring 1204 is configured to provide the flexibility of the flexible hub 104 when the center portion 1202 is coupled to and restrained from flexing by the adapter plate 308 (and the spinner 202) and the outer perimeter portion is coupled to and restrained from flexing by the impeller plate 106. In additional to the flexible material allowing the flexible hub 104 to flex in the unrestrained inner portion of the outer ring 1204, the radial hub slots 1206 provide additional flexibility by creating a number of "fingers" between the center portion 1202 and the outer perimeter portion.

Many of the functional units described in this specification have been labeled as modules, in order to more particularly emphasize their implementation independence. For example, a module may be implemented as a hardware circuit comprising custom VLSI circuits or gate arrays, off-the-shelf semiconductors such as logic chips, transistors, microprocessors, microcontrollers or other discrete components. A module may also be implemented in programmable hardware devices such as field programmable gate arrays, programmable array logic, programmable logic devices or the like.

Modules may also be implemented in software for execution by various types of processors. An identified module of executable code may, for instance, comprise one or more physical or logical blocks of computer instructions that may, for instance, be organized as an object, procedure, or function. Nevertheless, the executables of an identified module need not be physically located together, but may comprise disparate instructions stored in different locations which, when joined logically together, comprise the module and achieve the stated purpose for the module.

Indeed, a module of executable code could be a single instruction, or many instructions, and may even be distributed over several different code segments, among different programs, and across several memory devices. Similarly, operational data may be identified and illustrated herein within modules, and may be embodied in any suitable form and organized within any suitable type of data structure. The operational data may be collected as a single data set, or may be distributed over different locations including over different storage devices, and may exist, at least partially, merely as electronic signals on a system or network.

While the invention herein disclosed has been described by means of specific embodiments, examples and applications thereof, numerous modifications and variations could be made thereto by those skilled in the art without departing from the scope of the invention set forth in the claims.

What is claimed is:

1. A flexible hub system arranged about a rotational axis, comprising:

a rigid disk-shaped impeller plate having an upper side and a lower side, the impeller plate centered on the rotational axis and including a flexible portion centered on the rotational axis and comprised of a flexible material, the impeller plate further including a plurality of discharge outlets proximate to an outer edge of the impeller plate, a plurality of radial impeller vanes, each radial impeller vane extending outward from the lower side, and wherein the impeller plate is configured for coupling to a drive shaft centered on the rotational axis; and a volute centered on the rotational axis and including a central volute hole, wherein the volute is coupled to the impeller plate such that the impeller vanes are interposed between the volute and the impeller plate and the discharge outlets are located within a perimeter base of the volute, whereby upon submerging of the flexible hub system in a fluid and rotation of the flexible hub system around the rotational axis the flexible hub system is rotated and fluid is drawn into the central volute hole and is discharged out the discharge outlets, whereby suction is created.

2. The flexible hub system of claim 1, wherein the flexible portion is disk-shaped.

3. The flexible hub system of claim 1, wherein the flexible portion includes a central circular portion and an outer ring.

4. The flexible hub system of claim 3, wherein the central circular portion includes a central hole.

5. The flexible hub system of claim 3, wherein the central circular portion has a first thickness greater than a thickness of an adjacent portion of the outer ring.

6. The flexible hub system of claim 3, the outer ring including a plurality of radial hub slots.

7. The flexible hub system of claim 1, the flexible portion including a plurality of radial hub slots.

8. The flexible hub system of claim 1, wherein the discharge outlets are located between the impeller vanes.

9. The flexible hub system of claim 1, wherein the discharge outlets are evenly spaced with respect to the outer edge of the impeller plate.

10. The flexible hub system of claim 1, wherein the discharge outlets are curved to match the outer edge of the impeller plate.

11. The flexible hub system of claim 1, including eight discharge outlets and eight impeller vanes.

12. The flexible hub system of claim 11, wherein the impeller vanes are evenly spaced round the impeller plate and each discharge outlet is located between adjacent impeller vanes.

13. The flexible hub system of claim 1, the volute including a flange at the perimeter base of the volute.

14. The flexible hub system of claim 13, wherein the coupling of the volute to the impeller plate includes coupling the flange to the impeller plate.

15. The flexible hub system of claim 13, wherein the flange is configured for coupling to a toroidal base.

16. The flexible hub system of claim 13, further comprising a toroidal base removably coupled to a lower face of the flange.

17. The flexible hub system of claim 1, wherein the volute is permanently coupled to the impeller plate.

18. The flexible hub system of claim 1, wherein the impeller vanes are triangular in shape.

19. The flexible hub system of claim 18, wherein the impeller vanes are shaped such that the apex of the triangular shape is located proximate to the rotational axis.

20. The flexible hub system of claim 1, wherein the impeller vanes are linear.

* * * * *